US006302046B1

(12) United States Patent
Magee et al.

(10) Patent No.: US 6,302,046 B1
(45) Date of Patent: Oct. 16, 2001

(54) STEERING SENSOR SYSTEM FOR A MARINE VESSEL

(75) Inventors: Phillip D. Magee; Bret A. Martin, both of Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/667,185

(22) Filed: Sep. 21, 2000

(51) Int. Cl.[7] ..... B63H 25/00
(52) U.S. Cl. ..... 114/144 R; 440/1
(58) Field of Search ..... 440/1, 2, 53, 61, 440/63; 114/144 R, 144 RE, 144 A; 327/510, 511; 73/1.75

(56) References Cited

U.S. PATENT DOCUMENTS 4,744,322 5/1988 Nakasse ..... 114/144
5,244,426 * 9/1993 Miyashita et al. ..... 440/60
5,389,016 2/1995 Nestvall ..... 440/1
5,512,820 4/1996 Alfors ..... 324/207
5,627,465 5/1997 Alfors et al. ..... 324/207
5,694,039 12/1997 Alfors ..... 324/207

* cited by examiner

*Primary Examiner*—Ed Swinehart
(74) *Attorney, Agent, or Firm*—William D. Lanyi

(57) ABSTRACT

A steering sensor system is provided for a marine vessel in which a rotational position sensor is attached to a guide member that rotates about the central axis of the rotor of the rotational position sensor. A pin is attached to a moveable portion of the steering actuator and slidably disposed within a slot formed in the guide member. The pin is slidably within the slot as the moveable portion of the steering actuator moves along an acuate path that does not have the same center of rotation as the rotation of the rotatable portion of the rotational position sensor. The sliding of the pin within the slot of the guide member accommodates these different radii of curvature.

17 Claims, 4 Drawing Sheets

STEERING SENSOR SYSTEM FOR A MARINE VESSEL

BACKGROUND OF THE INVENTION

1. Field of the Invention

The present invention is generally related to a steering sensor system for a marine vessel and, more particularly, to an arrangement of guides and pins which allow a rotary sensor to monitor the movement of a steering actuator even though the paths of the steering actuator and the movable portion of the sensor are different from each other.

2. Description of the Prior Art

Many different types of power steering systems are well known to those skilled in the art of marine propulsion systems and marine vessel steering systems. Furthermore, many different types of position sensors, including Hall effect sensors, are well known to those skilled in the art of position sensing.

U.S. Pat. No. 5,389,016, which issued to Nestvall on Feb. 14, 1995, describes a steering system for planing watercraft. The arrangement in a steering and propulsion system for a planing type motorboat is described. The boat is provided with a means for adjusting the trim position. Steering characteristics of the boat are improved by providing the steering mechanism with a sensor for detecting rudder displacement. The sensor is connected to the trim position adjustment means via a microprocessor for recording the degree of steering displacement and is adapted to trim down the bow of the boat in the water when a certain steering displacement is exceeded.

U.S. Pat. No. 4,744,322, which issued to Nakase on May 17, 1988, describes a remote steering system for a marine propulsion craft. Several embodiments of the improved mechanisms for controlling an outboard drive of a marine watercraft are disclosed. In each embodiment, there is provided a hand held control unit that permits remote steering and engine control of the watercraft. In some embodiments, the hand held control includes a rotatable control element for effecting steering and a reciprocating control element for killing the engine. In some embodiments, the controls for the engine and steering are designed to be operated by different fingers of the user and in other embodiments, they are designed so as to be operated by the same finger of the operator. In addition, there is included an improved sensor for sensing the steered position of the outboard drive.

U.S. Pat. No. 5,694,039, which issued to Alfors on Dec. 2, 1997, describes an angular position sensor having multiple magnet circuits. The rotational position sensor, or angular position sensor, has two pole pieces. Each of the pole pieces has a first end portion and a second end portion. The two end portions are arranged in overlapping parallel association to provide a gap therebetween. Two magnetically sensitive components are disposed in the gap between the second end portions of the two pole pieces. The two magnetically sensitive components are used to provide redundancy in the event that one of the magnetically sensitive components experiences a failure.

U.S. Pat. No. 5,627,465, which issued to Alfors et al on May 6, 1997, describes a rotational position sensor with mechanical adjustment of offset and gain signals. The sensor is provided with a rotatable magnetic structure that comprises a primary magnet and a secondary magnet. The primary and secondary magnets are adjusted in position relative to each other in order to achieve an adjustability of the gain and offset characteristics of an output signal from a magnetically sensitive component disposed within the magnetic field of the magnetic structure. The primary and secondary magnets are rigidly maintained in position relative to each other and disposed for rotation about an axis of rotation. Each magnet has a magnetic axis extending through its first and second magnet poles. The two magnetic axes rotate within parallel planes that are each perpendicular to the axis of rotation of the magnetic structure.

U.S. Pat. No. 5,512,820, which issued to Alfors on Apr. 30, 1996, describes a rotational position sensor with a two-part rotatable member to resist jamming. A rotational position sensor is provided with a rotatable member that comprises first and second portions. The first portion is generally cylindrical and has an opening that is shaped to receive the second portion therein with a resilient spring disposed in the annular gap between the first and second portions when this assembly is accomplished. A magnet is molded into or otherwise affixed to an extension of the first portion and the second portion of the rotatable member is shaped to receive a shaft. Relative rotation is permitted between the first and second portions of the rotatable member so that the shaft will not be seized in position if the rotatable member is jammed within a stationary portion of the is sensor.

In control systems for marine vessels, it is important for a controller to be able to know the actual current position of the outboard drive as it pivots about a steering axis in response to steering commands from the operator of the marine vessel. The angular position of the outboard drive about its steering axis can be measured by various types of sensors that are well known to those skilled in the art. However, linking the sensor to the actual steering mechanism can be difficult because of the lack of space close to the location of the steering axis and, furthermore, because of the fact that the outboard drive rotates about a different center of rotation than the steering actuator. In other words, a steering actuator can move in an arcuate path of a significantly greater radius than the location at which the steering actuator can be readily attached to a sensor. Although various linkages can be employed to connect the steering actuator to the sensor, in order to determine the actual position of the steering actuator, these methods can require complex and expensive linkage arrangements. It would therefore be significantly beneficial if a relatively inexpensive method could be provided for causing a sensor to move in coordination with a steering actuator so that the position of the steering actuator can be monitored, even though the steering actuator moves along an arcuate path that differs in radius of curvature than the guide arm attached to the sensor for conveying the steering actuator position to the sensor so that the steering actuator position can be sensed by a control system.

SUMMARY OF THE INVENTION

A preferred embodiment of the present invention provides a steering sensor system for a marine vessel which comprises a pin which is attachable to a steering actuator. It also comprises a sensor which is attachable to a portion of the marine vessel, such as the transom or a bracket attached to the transom, wherein the sensor has a stationary portion and a moveable portion. The steering sensor system further comprises a guide member which is attached for movement with the moveable portion of the sensor, wherein the pin is slidably attached to the guide member. As a result of the structure of the present invention, movement of the steering actuator along a first path causes the guide member to move the moveable portion. Therefore, the sensor can detect the position of the guide member and provide a signal to a vessel control system.

The guide member comprises an arm with a slot in which the pin is slidably disposed. The sensor can be a rotary position sensor having a moveable portion which is rotatable relative to the stationary portion.

In one embodiment of the present invention, the guide member is formed from a bent wire member and the slot is provided between two segments of the bent wire member.

The pin is adapted to slide along the length of the guide member in response to movement of the steering actuator. The moveable portion of the sensor is caused to rotate in response to the pin sliding along the length the guide member in response to movement of the steering actuator. The sensor can be attached to a transom of the marine vessel or to any other stationary bracket attached to the marine vessel.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1:
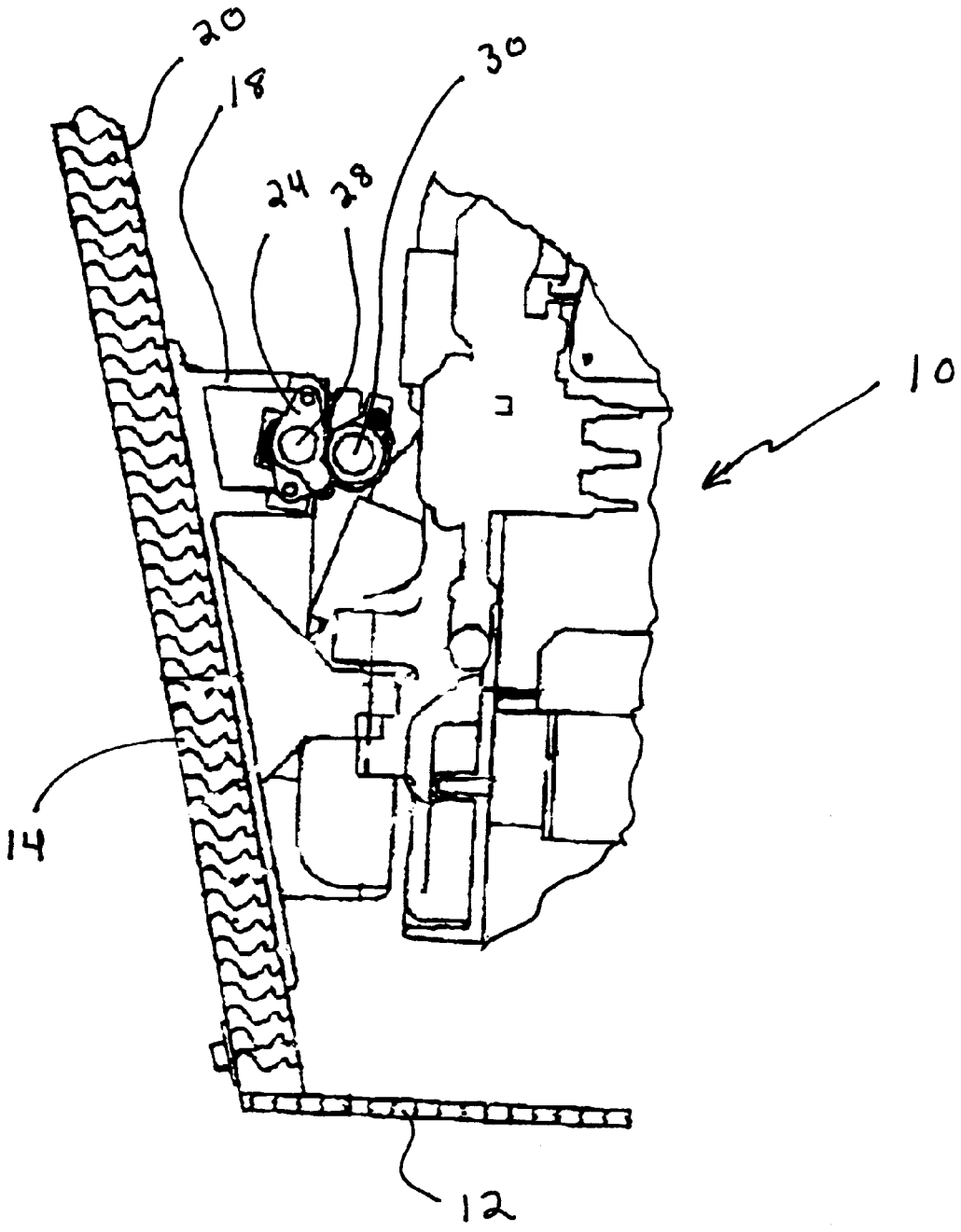
FIGURE 1 (PRIOR ART)
FIG. 1 is a section view of a marine vessel.

Throughout the description of the preferred embodiment, like components will be identified by like reference numerals.

FIG. 1 is a section view showing the rear portion of a marine vessel structure. The outboard unit of the marine vessel is not shown. An engine 10 is supported within the marine vessel above the floor portion 12 and in front of the transom 14 located at the stern of the marine vessel. The transom bracket 18 is attached to an inside surface 20 of the transom 14. A steering actuator 24 is attached to the transom bracket 18 and comprises a hydraulic cylinder 28 shown as an end view in FIG. 1. Associated with the hydraulic cylinder 28 is a valve 30 which controls the flow of hydraulic fluid into and out of the steering cylinder 28 and allows a power steering system or power assist steering system to operate. FIG. 1 is provided so that the relative locations of the steering actuator 24, the hydraulic cylinder 28, and the hydraulic control valve 30 are located with respect to the transom 14 and the engine 10 of a marine vessel.

Figure 2:
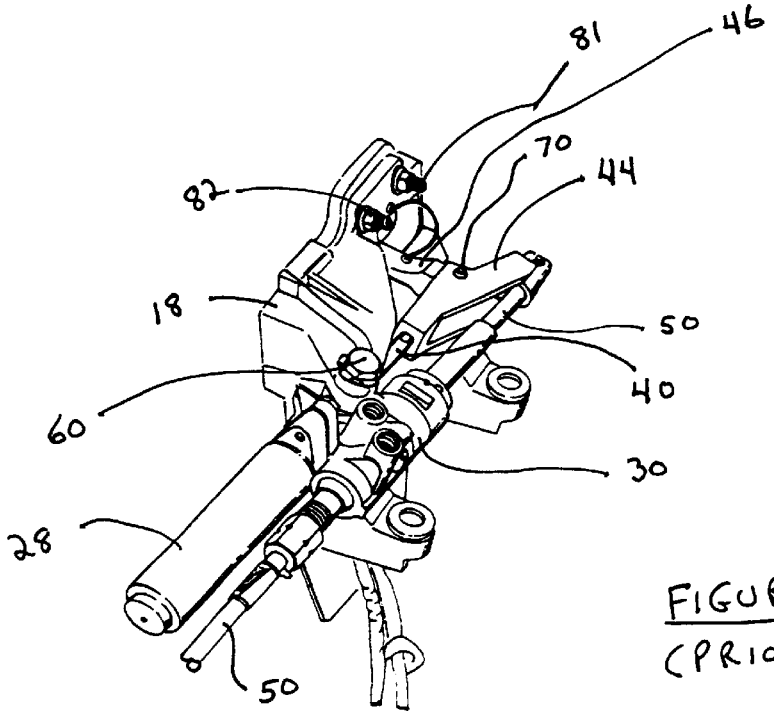
FIGURE 2 (PRIOR ART)
FIG. 2 is an isometric view of a known power steering actuator.

FIG. 2 is an isometric view of the steering actuator. The hydraulic cylinder 28 causes a piston rod 40 to move out of and into the cylinder 28. The piston rod 40 is attached to a clevis 44 which, in turn, is attached to a steering element 46, or steering arm, of the outboard drive unit. The steering element 46 extends through an opening in the transom 14 and also through an opening through the transom bracket 18.

With continued reference to FIG. 2, the clevis 44 is also attached to a steering cable mechanism 50 which comprises several parts that are attached to each other linearly. The steering cable mechanism 50 extends through a control valve 30. The steering cable mechanism 50 is caused to move axially with respect to the control valve 30. Manually caused movement of the steering cable mechanism 50 cause hydraulic fluid to be routed in a preselected manner by the valve 30 which causes hydraulic fluid to flow into and out of the hydraulic cylinder 28. Therefore, when a marine vessel operator causes movement of the steering cable mechanism 50, the hydraulic fluid is used to provide the necessary force to cause the steering actuator to move the clevis 44 and the steering lever 46.

It should be understood that the steering element 46 rotates about the generally vertical steering axis of the outboard drive. Therefore, the clevis 44 moves in a path that is restricted by the rotational movement of the steering element 46 about the steering axis. Since the movement of the piston rod 40 relative to the hydraulic cylinder 28 is generally linear, movement of the hydraulic cylinder 28 must be allowed relative to the transom bracket 18. This is provided by the pivot axis 60 at the location where the steering actuator is attached to the transom bracket 18. Therefore, the hydraulic cylinder 28, the piston rod 40, and the clevis 44 all move along paths that are partially dictated by the rotatable attachment of the steering actuator at location 60, the steering axis of the outboard drive and the connection between the clevis 44 and the steering element 46.

With continued reference to FIG. 2, several other elements of the steering actuator should be noted. First, the pin location identified by reference numeral 70 on the clevis 44 is a location where a pin of the present invention will be attached. That pin of the present invention will be described in greater detail below, but it is important to recognize that the pin would be attached to the clevis 44 and to the steering member 46 at the location identified by reference numeral 70 in FIG. 2. It is also important to note that the transom bracket 18 is provided with two threaded studs, 81 and 82. These two studs define a location at which the present invention will be attached to the transom bracket 18 as will be described in greater detail below.

Figure 3:
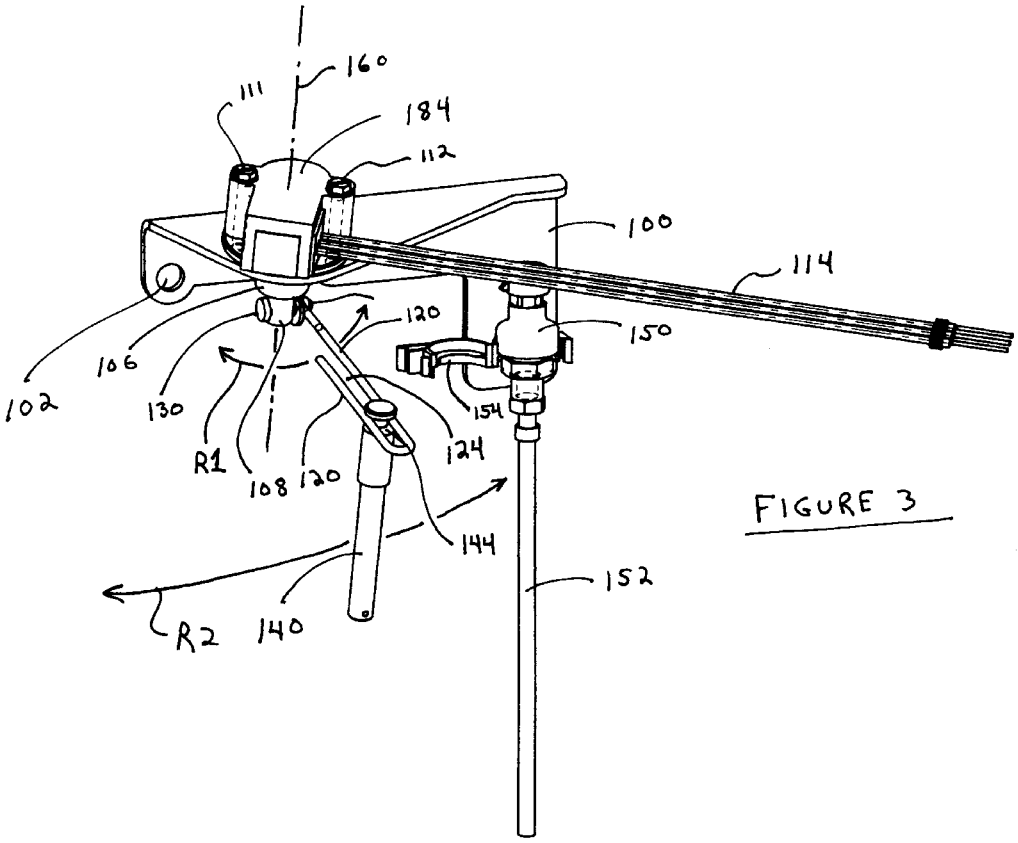
FIG. 3 is an isometric view of the present invention.

FIG. 3 is an isometric view of the present invention. A bracket 100 is provided with holes, including hole 102, that allow the bracket 100 to be attached to the transom bracket 18 described above. An adapter 106 serves as a housing for a position sensor. In a preferred embodiment of the present invention, the position sensor is a rotational position sensor which will be described in greater detail below in conjunction with FIG. 4. A driver 108 is attached to a rotor of the sensor which is located within the adapter 106. The adapter 106 is attached to the bracket 100 with bolts 111 and 112. Wires 114 are connected to the sensor within the adapter 106 and allow signals to be provided by the sensor to an external component, such as an engine control unit (ECU) of a marine vessel. A guide member 120 is attached to the driver 108 with a connector pin 130. It should be noted that the guide member 120 is pivotable about a horizontal axis relative to the driver 108 because of the allowed rotation of the connector pin 130 relative to the driver 108.

With continued reference to FIG. 3, it should be noted that the guide member 120 in a preferred embodiment of the present invention comprises a wire member that is bent to define a slot 124. A pin 140 is slidably disposed within the slot 124. This slidably relationship between the pin 140 and the slot 124 is facilitated by the grooved end portion 144 of the pin 140.

Also shown in FIG. 3 is a pressure sensor 150 and a pressure conduit 152 which is held against the bracket 100 by a clamp 154. It should be understood that the pressure sensor 150, the conduit 152, and the clamp 154 are not directly related to the present invention, but are shown in FIG. 3 because they are attached to the same bracket 100.

Arrow R1 shows the general path that the guide member 120 follows as it rotates about the centerline 160 of the sensor located within the adapter 106. Arrow R2 illustrates the general path along which the pin 140 travels in response to movement of the clevis 44 and the steering actuator. Arrows R1 and R2 do not have a common center of rotation.

Figure 4:
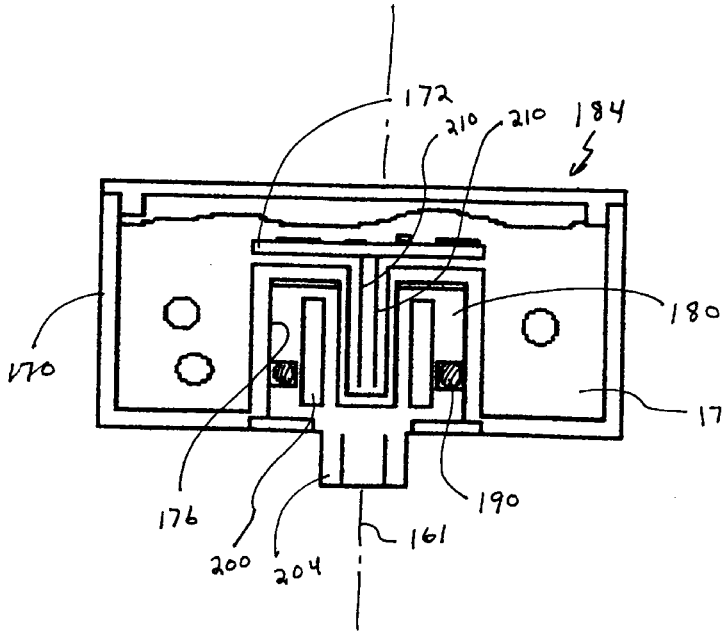
FIGURE 4 (PRIOR ART)
FIG. 4 is a section view of a known type of rotational position sensor.

FIG. 4 is a section view of a rotational position sensor that can be used in conjunction with the present invention and can be located within the adapter 106 shown in FIG. 3. A case 170 encloses a circuit board 172 that is encapsulated within a potting material 174. Within a generally cylindrical pocket 176 defined by the housing 170, a rotor 180 is disposed for rotation about axis 161 which is identical with axis 160 described above in conjunction with FIG. 3 when the sensor 184 is disposed within the adapter 106. The rotor is provided with a circumferential groove which an O-ring 190 is disposed. The rotor is also provided with one or more magnets 200 that provide a moving magnetic field as the rotor 204 rotates about axis 161. The movement of the magnetic field affects the flux strength and direction at two or more pole pieces 210 and this flux is monitored by appropriate components on circuit board 172. As a result of the operation of the type of sensor shown in FIG. 4, which is well known to those skilled in the art, signals can be provided which are representative of the relative rotational positions of the rotor 204 and the pole pieces 210. The rotor 204 provides a rotary portion of the sensor and the pole pieces 210, along with the potted circuit board 172, provide a stationary portion of the sensor. The rotor 204 is attached to the driver 108 described above in conjunction with FIG. 3.

Figure 5:
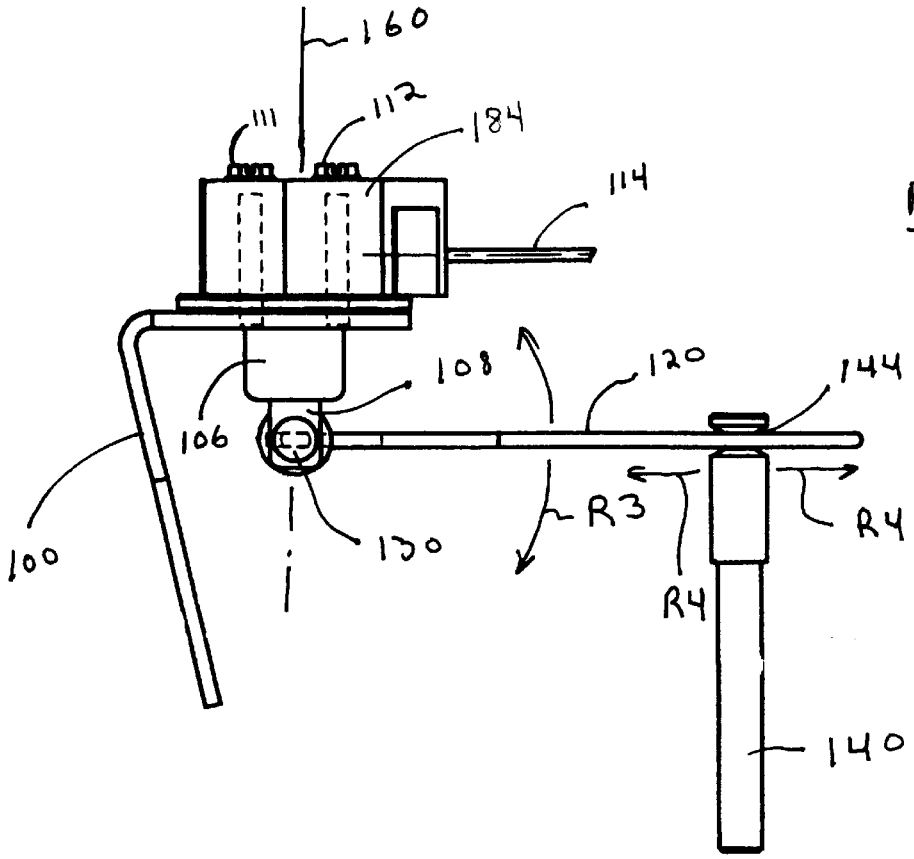
FIG. 5 is an alternative view of the present invention shown in FIG. 3.

FIG. 5 is a side view of the structure described above in conjunction with FIG. 3. Attached to the bracket 100 is the adapter 106 which is fastened along with the sensor to the bracket 100 with two bolts, 111 and 112. The driver 108 extends downward through an opening in the adapter 106 and is attached to the rotor 204 of the rotational position sensor described above in conjunction with FIG. 4. Wires 114 transmit signals from the circuit board 172 of the sensor 184, described above in conjunction with FIG. 4, to an engine control unit or other control mechanism of a marine vessel. Arrow R3 in FIG. 5 illustrates the potential rotational movement of the guide member 120 relative to the driver 108 and about a horizontal axis. The use of the connector pin 130, which is rotatable relative to the driver 108, allows this movement R3 which permits the system to adjust to certain inaccuracies and misalignments during assembly and during operation of the system. The pin 152 is free to slide, as represented by arrow R4, within the slot 124 formed by the wire member of the guide member 120. It should be understood that a wire member is not required to form the guide member 120 and the slot 124. Alternatively, a solid bar could be provided with a machine slot formed through it.

Figure 6:
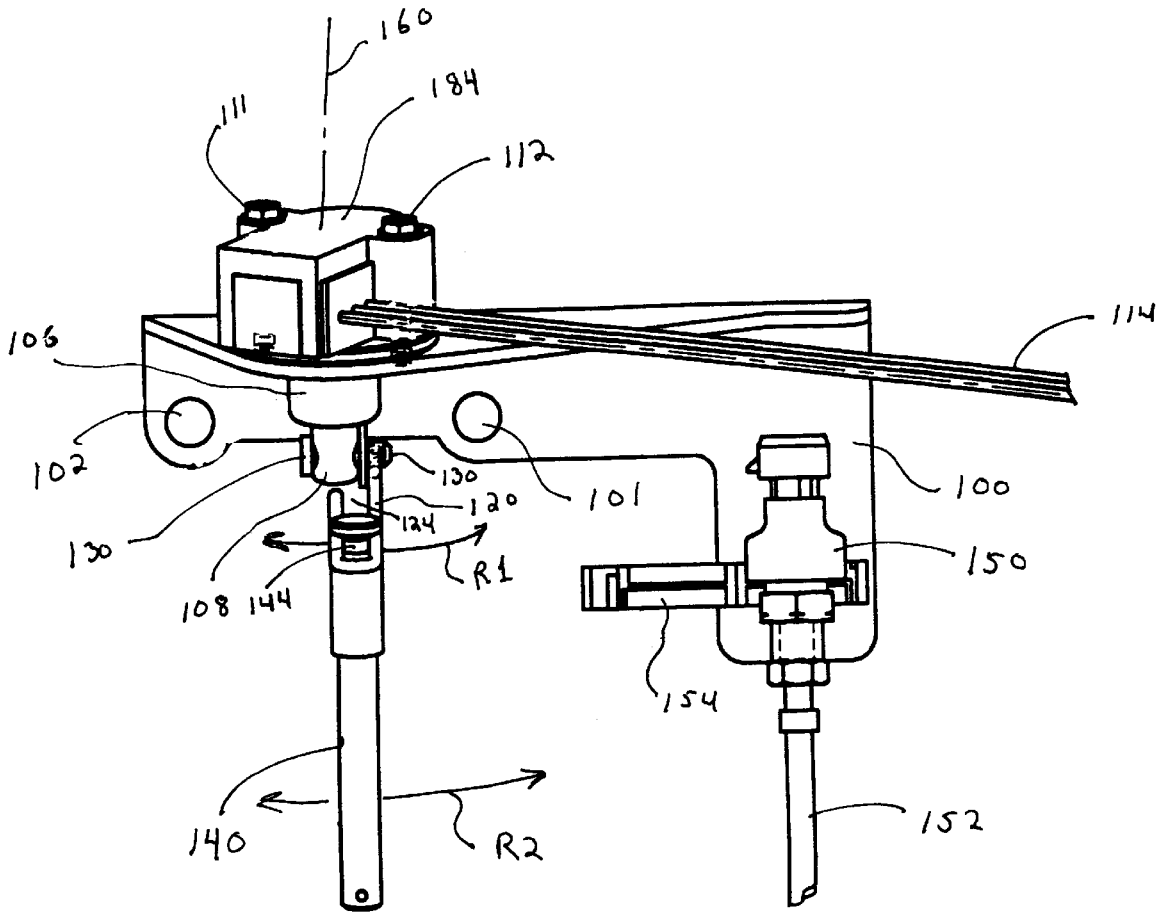
FIG. 6 is a second alternative view of the present invention shown in FIG. 3.

FIG. 6 is a front view of the present invention, showing the bracket 100 and the two holes, 101 and 102, which extend through the bracket 100 and allow it to be attached to the two locations identified by reference numerals 81 and 82 in FIG. 2. This also allows the bracket 100 to be rigidly fastened to the transom bracket 18 with the bolts 81 and 82. FIG. 6 also shows the adapter 106 attached to the bracket 100 with bolts 111 and 112, and the pressure sensor 150 described above. The driver 108 and adapter 106 extend downward through an opening in the bracket 100 and is attached to the rotor 204 of the sensor which is disposed within the adapter 106. The rotatable member 204 of the sensor 184 and the attached driver 108 are rotatable about axis 160.

The guide member 120, with its slot 124 are attached to the driver 108 and are rotatable along a path identified by arrow R1. The radius of curvature of this path R1, for any point on the guide member 120, is defined about axis 160. The pin 140, which is attached to the clevis 44 described above in FIG. 2, rotates about a different path R2 which is defined by the steering arm 46 and the steering axis of the outboard drive (which is generally outside the boat) and the movement of the piston rod 40 and clevis 44 described above in conjunction with FIG. 2 which, in turn, is defined by an axis extending through bolt 60 illustrated in FIG. 2. It should be understood that paths R2 and R1 are not coincident with each other and are not restricted by the same axes or radii of curvature.

The pin 140 is provided with a head portion 144 that is shaped, or grooved, to be received in the slot 124 of the guide member 120. The pin 140 can therefore slide within the slot 124 as the pin moves along the path R2. This movement of the pin 140 along path R2, in combination with the sliding of the pin within the slot 124, cause the guide member 120 to move along path R1 and allow the driver 108 to rotate about axis 160.

The relatively simple and inexpensive linkage system between the clevis 44 and the sensor 184 allows the sensor to be attached to the clevis 44 in a way that provides a signal from the sensor 184 that is representative of the position of the pin 140 and the clevis 44. As a result, the signal from the sensor 184 can be used to determine the actual position of the steering actuator of the marine vessel.

It should be understood that the signal provided by the rotational position sensor is not necessarily linearly related to the physical position of the clevis 44. However, for any known system, it is a simple matter to provide a means for converting the magnitude of the signal from the sensor 184 to a magnitude that is directly and linearly related to the position of the clevis 44 after empirically or theoretically determining this relationship. The lack of linear relationship between the position of the clevis 44 and the rotational position of the rotatable portion of the sensor 184 is a result of the sliding capability of the pin 140 within slot 124. This slidability of the pin 140 within slot 124 is necessary because the clevis rotates along a path which has a different center of rotation than the axis 160 about which the rotatable portion of the sensor rotates.

Although the present invention has been described in particular detail and illustrated with considerable specificity to show one preferred embodiment of the present invention, it should be understood that alternative embodiments are also within its scope.

What is claimed is:

1. A steering sensor system for a marine vessel, comprising:

a pin which is attachable to a steering actuator;

a sensor which is attachable to a portion of said marine vessel, said sensor having a stationary portion and a movable portion;

a guide member attached to said movable portion of said sensor, said pin being slidably attached to said guide member; and whereby movement of said steering actuator along a first path causes said guide member to move said movable portion.

2. The system of claim 1, wherein:

said guide member comprises an arm with a slot, said pin being slidably disposed within said slot.

3. The system of claim 1, wherein:

said sensor is a rotary position sensor.

4. The system of claim 1, wherein:

said movable portion is rotatable relative to said stationary portion.

5. The system of claim 2, wherein:

said guide member is formed from a bent wire member, said slot being provided between two segments of said bent wire member.

6. The system of claim 5, wherein:

said pin is adapted to slide along the length of said guide member in response to said steering actuator.

7. The system of claim 6, wherein:

said movable portion of said sensor is caused to rotate in response to said pin sliding along the length of said guide member.

8. The system of claim 1, wherein:

said sensor is attachable to a transom of said marine vessel.

9. A steering sensor system for a marine vessel, comprising:

a pin which is attachable to a steering actuator;

a sensor which is attachable to a portion of said marine vessel, said sensor having a stationary portion and a movable portion;

a guide member attached to said movable portion of said sensor, said pin being slidably attached to said guide member, said guide member comprising an arm with a slot, said pin being slidably disposed within said slot; and whereby movement of said steering actuator along a first path causes said guide member to move said movable portion.

10. The system of claim 9, wherein:

said sensor is a rotary position sensor and said movable portion is rotatable relative to said stationary portion.

11. The system of claim 9, wherein:

said guide member is formed from a bent wire member, said slot being provided between two segments of said bent wire member and said pin is adapted to slide along the length of said guide member in response to said steering actuator.

12. The system of claim 11, wherein:

said movable portion of said sensor is caused to rotate in response to said pin sliding along the length of said guide member.

13. The system of claim 9, wherein:

said sensor is attachable to a transom of said marine vessel.

14. A steering sensor system for a marine vessel, comprising:

a pin which is attachable to a steering actuator;

a sensor which is attachable to a portion of said marine vessel, said sensor having a stationary portion and a movable portion, said sensor being a rotary position sensor and said movable portion is rotatable relative to said stationary portion;

a guide member attached to said movable portion of said sensor, said pin being slidably attached to said guide member, said guide member comprising an arm with a slot, said pin being slidably disposed within said slot; and whereby movement of said steering actuator along a first path causes said guide member to move said movable portion.

15. The system of claim 14, wherein:

said guide member is formed from a bent wire member, said slot being provided between two segments of said bent wire member and said pin is adapted to slide along the length of said guide member in response to said steering actuator.

16. The system of claim 15, wherein:

said movable portion of said sensor is caused to rotate in response to said pin sliding along the length of said guide member.

17. The system of claim 16, wherein:

said sensor is attachable to a transom of said marine vessel.

* * * * *